US008036772B2

(12) United States Patent
Mäder

(10) Patent No.: US 8,036,772 B2
(45) Date of Patent: Oct. 11, 2011

(54) PROCESS AND APPARATUS FOR MONITORING SHEET-LIKE PRODUCTS TRANSPORTED BY CLAMPS

(75) Inventor: Carl Conrad Mäder, Hittnau (CH)

(73) Assignee: Ferag AG, Hinwil (CH)

( * ) Notice: Subject to any disclaimer, the term of this patent is extended or adjusted under 35 U.S.C. 154(b) by 618 days.

(21) Appl. No.: 11/997,031

(22) PCT Filed: Feb. 1, 2007

(86) PCT No.: PCT/CH2006/000260

§ 371 (c)(1),
(2), (4) Date: Jul. 10, 2008

(87) PCT Pub. No.: WO2007/012206

PCT Pub. Date: Feb. 1, 2007

(65) Prior Publication Data

US 2009/0143895 A1 Jun. 4, 2009

(30) Foreign Application Priority Data

Jul. 29, 2005 (CH) ..... 1276/05

(51) Int. Cl.
*B42B 2/00* (2006.01)
*B65H 7/02* (2006.01)
*B65G 47/86* (2006.01)

(52) U.S. Cl. ..... 700/213; 270/52.23; 271/204; 198/644; 198/470.1

(58) Field of Classification Search ..... None
See application file for complete search history.

(56) References Cited

U.S. PATENT DOCUMENTS 5,613,669 A 3/1997 Grueninger
5,956,414 A 9/1999 Grueninger
6,457,708 B2 * 10/2002 Honegger ..... 271/204
7,712,603 B2 * 5/2010 Mader ..... 198/644
2002/0113977 A1 8/2002 Silvestre
2007/0132168 A1 * 6/2007 Muller et al. ..... 270/52.23

FOREIGN PATENT DOCUMENTS

EP 1 321 410 A1 6/2003

OTHER PUBLICATIONS

International Search Report from Corresponding International Application No. PCT/CH2006/000260, mailing date Jul. 28, 2006, 4 pages in English and German.
PCT Request in German.
International Preliminary Report on Patentability (Chapter I of the Patent Cooperation Treaty) from Corresponding International Application No. PCT/CH2006/000260, dated Feb. 26, 2008, 6 pages.

* cited by examiner

*Primary Examiner* — Gene Crawford
*Assistant Examiner* — Yolanda Cumbess
(74) *Attorney, Agent, or Firm* — Brinks Hofer Gilson & Lione

(57) ABSTRACT

The invention relates to a first product (20) which supports identification information (30) and a second product (22) which, optionally, supports identification information (30'). Said first and second products are maintained and transported together by a clamp (12), such that the second printing product (22) at least partially overlaps the first printing product (20). The identification information (30) of the first printing product (20) is arranged in the edge section (26) and the identification information (30') of the second printing product (22) is free. The printing products (22, 22) are subjected to an optical-electronic control where an image capturing device (38) captures an image of the identification information (30, 30'), when a control point is passed. The captured image is electronically processed and the result thereof is transformed into control signals.

13 Claims, 3 Drawing Sheets

PROCESS AND APPARATUS FOR MONITORING SHEET-LIKE PRODUCTS TRANSPORTED BY CLAMPS

RELATED APPLICATIONS

This application is a nationalization of PCT application No. PCT/CH2006/000260 filed on Feb. 1, 2007, claiming priority based on Swiss No. 01276/05 filed on Jul. 29, 2005, the contents of which are incorporated herein by reference in their entirety.

The present invention relates to a process for monitoring sheet-like products, in particular printed products transported by means of clamps of a transporting arrangement as claimed in patent claim 1, and to an apparatus for carrying out the process as claimed in patent claim 13.

EP 1 321 410 A discloses a process and an apparatus which are intended for conveying sheet-like products and in the case of which in each case two or more products are gripped jointly, in the region of their leading edges, by grippers of a gripper conveyor such that the edges are alternately spaced apart from one another. In a transfer region, the products are transferred to a removal arrangement such that each product at most partially overlaps the previously transferred product, the leading edges of the products being spaced apart from one another. The products are thus directly accessible for further processing. If a gripper of the gripper conveyor has been loaded with the incorrect number of products or with incorrect products, this may give rise to problems during further processing, for example by the incorrect number of products, or incorrect products, being fed to a further-processing station.

EP 0 685 420 A discloses a monitoring process which is intended for use in the production of printed products and can be used in high-capacity processes for producing printed products by collecting, inserting and/or collating operations, for example by way of a drum. The resulting products are compared, following each addition of a further constituent part, by virtue of an image being recorded by an image-recording device and the recorded image being compared with a corresponding stored calibration image, and the comparison results are used for generating control signals, for example for ejecting defective products, or alarm signals.

Furthermore, EP 0 897 887 A discloses a process and an apparatus for monitoring the thickness of continuously conveyed sheet-like products. Monitoring elements are introduced into the conveying stream of the individually conveyed printed products and are assigned to each printed product. The monitoring elements comprise a pair of monitoring levers with clamping jaws which are pressed against one another by a pressing force and clamp in the printed product between them. Interacting with one another by way of this clamping operation, the monitoring element and printed products pass through a monitoring region together. In this monitoring region, for the quantitative registration of the interaction between the monitoring element and printed product, an image is recorded of a respective edge of the two monitoring levers and of the spacing between these edges, this spacing varying with the thickness of the pressed printed product, and this image recording is used to determine the measured value corresponding to the spacing. The measurement of the spacing of which an image has been formed is compared with a desired range assigned to each monitoring element. The desired range is a predetermined tolerance range which is combined with a desired value from a calibration measurement, the calibration measurement being carried out for the specific monitoring element and a correct product.

It is an object of the present invention to provide a process which is intended for monitoring sheet-like products transported by means of clamps of a transporting arrangement and which, in a manner which does not adversely affect the products, makes it possible to monitor whether each of the product-transporting clamps has been loaded correctly with two correct products. It is also an object of the present invention to provide an apparatus for carrying out the process.

According to the invention, a first product, which carries identification information, and a second product, which likewise carries identification information, are jointly retained and transported such that the second product partially overlaps the first product and a peripheral portion, which carries the identification information of the first product and the identification information of the second product are exposed on the same side of the products. In relation to transporting the products individually, transporting two products jointly by way of a clamp in each case makes it possible, with the same operating cycle, to double the transporting capacity or, with the same transporting capacity, to halve the operating cycle or the speeds at which clamps are moved, which results in the transporting arrangement operating extremely smoothly.

In order to monitor whether each of the clamps has been loaded with a first product and a second product, the products retained jointly by a clamp, as they move past a monitoring location, are subjected to optoelectronic monitoring. In this case, a stationary image-recording device is used to record an image of the identification information of the two products, the recorded image is processed electronically and the results of the electronic processing is processed further to form control signals.

Since the process according to the invention operates in a contactless manner, the risk of damage to the products is avoided. Optoelectronic monitoring allows very high processing speeds. Furthermore, the costs for monitoring using the process according to the invention are low since the corresponding apparatus does not need to have any moving parts. Furthermore, the process according to the invention makes it possible to monitor whether each of the clamps has been loaded with two correct products, and this allows reliable and correct further processing and also a warning to be given in respect of incorrect products, which can then be ejected.

The invention is explained in more detail with reference to exemplary embodiments illustrated in the drawing, in which, purely schematically:

Figure 2:
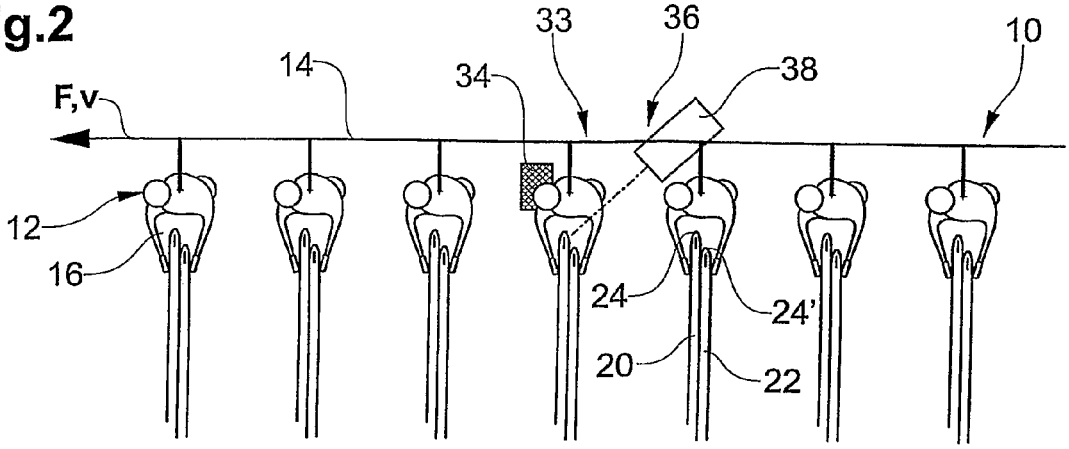
FIG. 2 shows a view of a detail of a transporting arrangement, of which the clamps transport the printed products in a hanging position, and of a monitoring arrangement with an image-recording device arranged obliquely in relation to the transporting arrangement.
Figure 5:
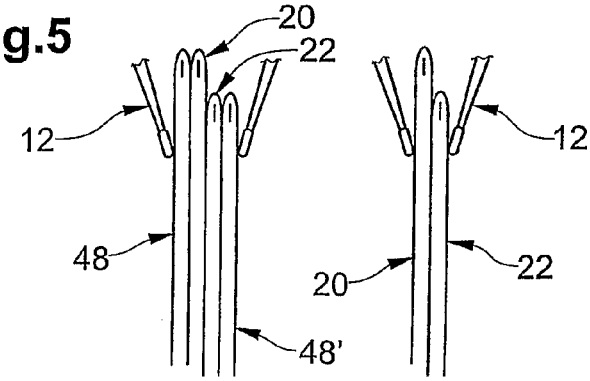
Figure 6:
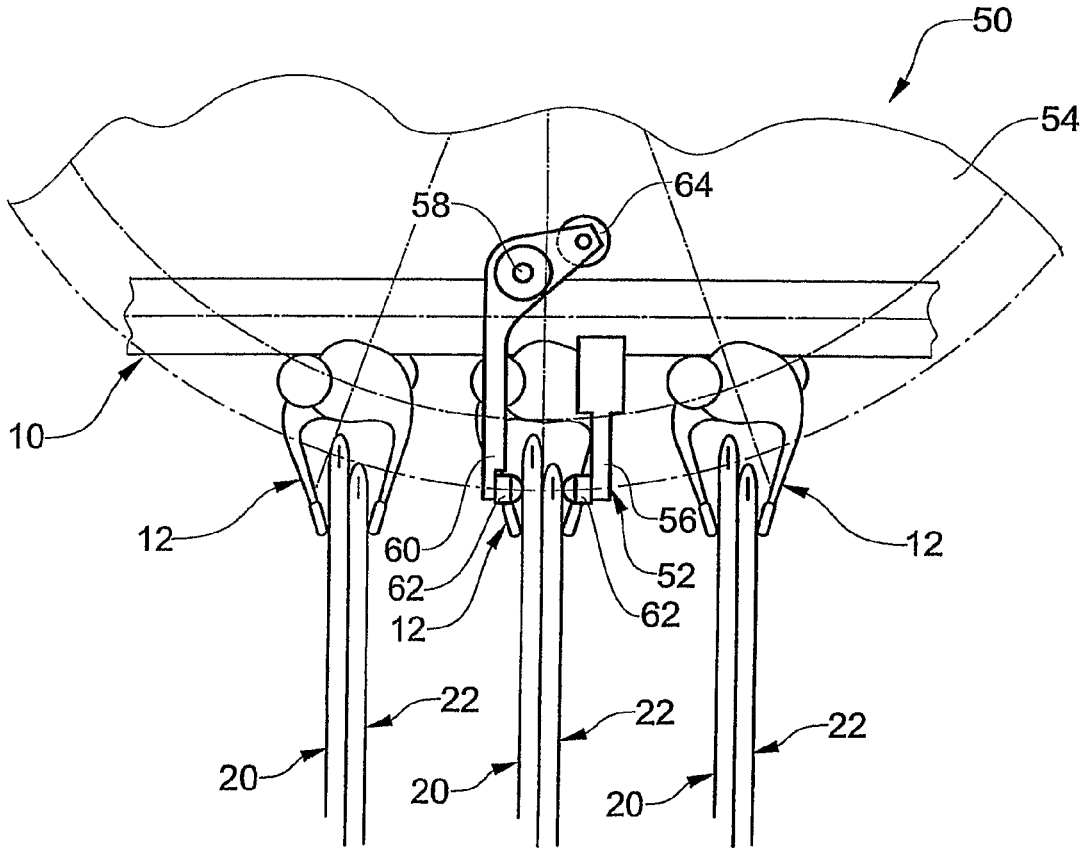

FIG. 5 shows another two clamps from that embodiment of the transporting arrangement which is shown in FIG. 2, the one clamp having been loaded incorrectly with four printed products and the other clamp having been loaded correctly with two printed products; and FIG. 6 shows a view of a thickness-measuring arrangement which is provided downstream of the monitoring arrangement and is intended for measuring the thickness of the printed products transported jointly by a respective clamp.

Figure 1:
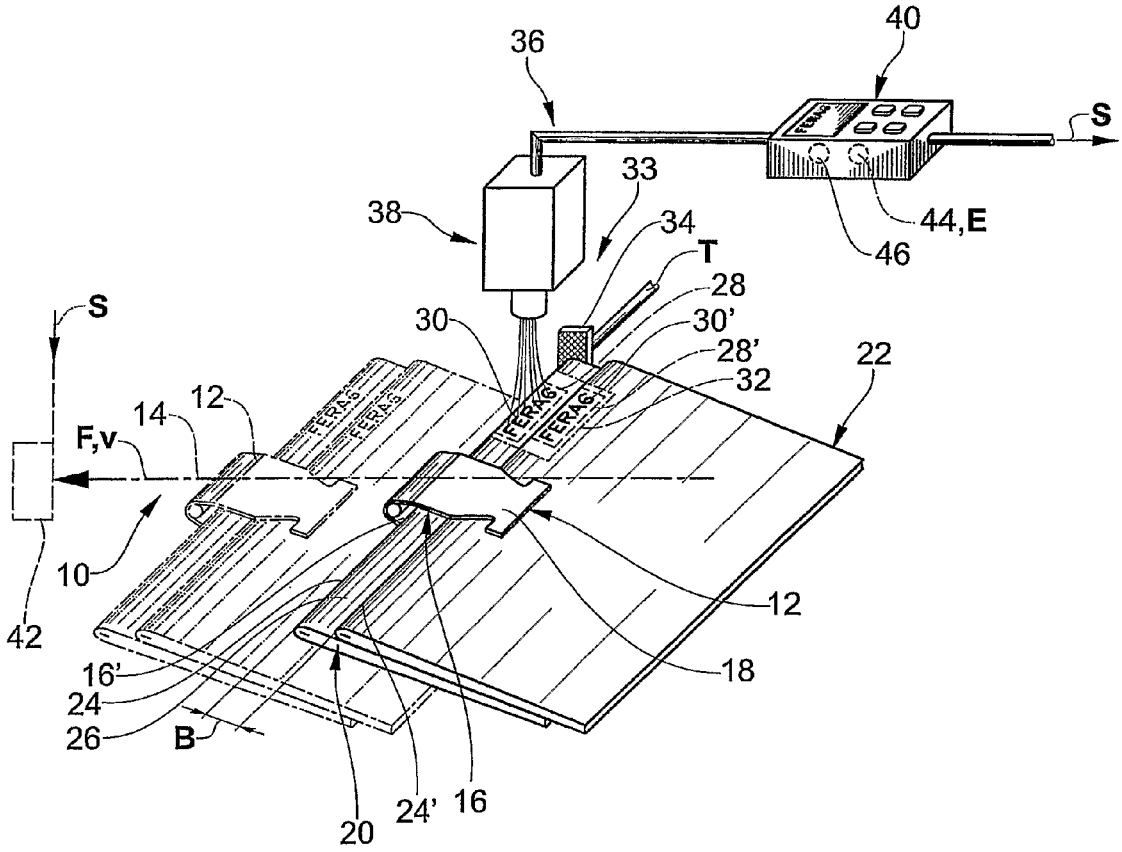
FIG. 1 shows a perspective plan view of a transporting arrangement, which has clamps for transporting pairs of printed products, and of a monitoring arrangement for the optoelectronic monitoring of the printed products.

FIG. 1 shows part of a transporting arrangement 10 with clamps 12 which are spaced apart one behind the other on a circulating conveying means 14, for example a conveying chain guided in a guide channel. The conveying means 14 is driven at a conveying speed v in a conveying direction F. The mouth 16 of the clamps 12 runs in the rearward direction, counter to the conveying direction F, and slightly obliquely downward in relation to the horizontally running portion of the transporting arrangement 10. The two jaws 18 of the clamps 12, these jaws forming the mouth 16, hold a first printed product 20 and a second printed product 22 clamped in between them in the mouth 16. The leading edges 24, 24' of the first and second printed products 20, 22 respectively, as seen in the conveying direction F, run at least more or less parallel to one another and at right angles to the conveying direction F. The two printed products 20, 22 are retained jointly by the clamp 12 such that the leading edges 24, 24' are alternately spaced apart from one another, the leading edge 24 of the first printed product 20 being closer to the bottom 16' of the mouth 16 than the leading edge 24' of the second printed product 22.

The second printed product 22, which rests in imbricated fashion on the first printed product 20, as seen in the conveying direction F, only partially overlaps the first printed product 20 and leaves free, on the latter, a strip-like peripheral portion 26, of width B, adjoining the leading edge 24. The first printed product 20 has identification information 30 in this peripheral portion 26, in an information zone 28 located on the outer right-hand side, as seen in the conveying direction F. It is also the case that the second printed product 22 has an information zone 28', likewise with identification information 30', in its corresponding peripheral portion 26, positioned laterally at the same location as the information zone 28.

32 is used to indicate, by way of chain-dotted lines, an image zone within which the information zones 28, 28' are located and which will be discussed in more detail at a later stage in the text.

Located at a monitoring location 33, to the side of the movement path of the clamps 12 and of the printed products 20, 22 transported thereby, is a clamp sensor 34, for example in the form of a light barrier, which generates a trigger signal T in each case when a clamp 12 moves into its sensor range.

The clamp sensor 34 is part of an optoelectronic monitoring arrangement 36, which also has an image-recording device 38, preferably in the form of a video camera, and a processing unit 40. The image-recording device 38 is connected to the processing unit 40 which, for its part, generates control signals S which, as is indicated by dashed lines, are fed to a further-processing station 42 provided downstream of the monitoring arrangement 36.

In that position of the clamp 12 which is illustrated by solid lines in FIG. 1, the information zone 28 of the first printed product 20 is located within the optical range of the image-recording device 38. If the clamp 20 has moved on in the conveying direction F by the width B of the peripheral portion 26, the information zone 28' of the second printed product 22 is located within the optical range of the image-recording device 38.

It is also possible for the image-recording device 38 to be set, and/or positioned, such that, in that position of the clamp 12 which is shown, the image zone 32 with the information zones 28 and 28' is located in the optical range of the image-recording device 38.

The processing unit 40 has a memory 44 for digitally storing a calibration image E. The processing unit 40 also contains an electronic comparison unit 46, for example in the form of a microprocessor, by means of which digitized images recorded by the image-recording device 38 can be compared with the digital calibration image E. The further-processing station 42 generates the control signals S in dependence on this comparison.

As can be seen from FIG. 1, the image-recording device 38 is directed more or less at right angles to the main surface of the printed products 20, 22, this main surface being predetermined by the mouth 16 of the clamps 12.

In the case of that embodiment of the transporting arrangement 10 which is shown in FIG. 2, the individually controllable clamps 12, once again, are spaced apart one behind the other on the conveying means 14, which is driven in circulation in the conveying direction F. In that part of the transporting arrangement 10 which is shown, the mouths 16 of the clamps 12 are directed downward, in which case the respectively two printed products 20, 22 retained by a clamp 12 are transported in a hanging position. As is shown in FIG. 1, here too, in each case a first printed product 20 and a second printed product 22 are retained jointly by a clamp 12 such that the edges 24, 24' are alternatively spaced apart from one another. In precisely the same way as is shown in FIG. 1, the two printed products 20, 22 each have an information zone 28, 28' with identification information 30, 30'.

The single difference between the monitoring arrangement 36 of the embodiment which is shown in FIG. 2 and that according to FIG. 1 is that the image-recording device 38 is likewise arranged outside the movement path of the clamps 12 and printed products 20, 22, but obliquely, at an angle of approximately 45°, in relation to the main surface of the printed products 20, 22.

Figure 3:
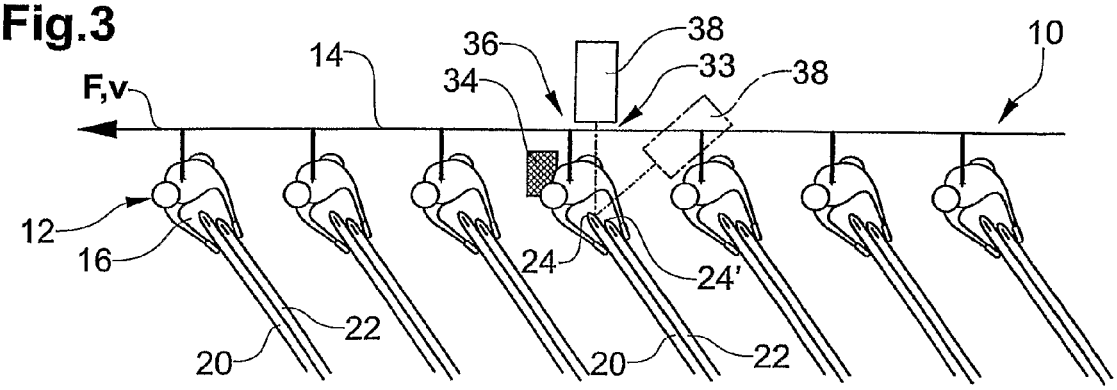
FIG. 3 shows, in the same illustration as FIG. 2, a detail of a transporting arrangement, which transports the printed products in an obliquely rearwardly running position, and of a monitoring arrangement with an image-recording device which is arranged at right angles to the transporting arrangement and/or at right angles to the main surface of the printed products.

FIG. 3 shows part of a transporting arrangement 10 which is of the same design as that according to FIG. 2, although the clamps 12 are retained in a state in which they are pivoted about their pivot axis, running at right angles to the conveying direction F, such that the mouth 16 of the clamps 12 is directed rearward and downwards in relation to the conveying direction F, through approximately 45° in respect of a vertical. As is indicated by chain-dotted lines, it is also possible, in the case of this pivoted position of the clamps 12, for the image-recording device 38 to be arranged in the same way as in the case where the printed products 20, 22 are transported in a vertically downwardly hanging state, according to FIG. 2. The obliquely rearwardly directed pivoted position of the clamps 12 according to FIG. 3, however, also allows the image-recording device 38 to be arranged vertically, as illustrated by dashed lines in FIG. 3.

As in the case of the embodiment according to FIG. 1, it is also the case with the embodiments according to FIGS. 2 and 3 that the clamp sensor 34 is positioned such that it emits a trigger signal T at each point in time at which the information zone 28 of the first printed product 20 is located within the optical range of the image-recording device 38.

Figure 4:
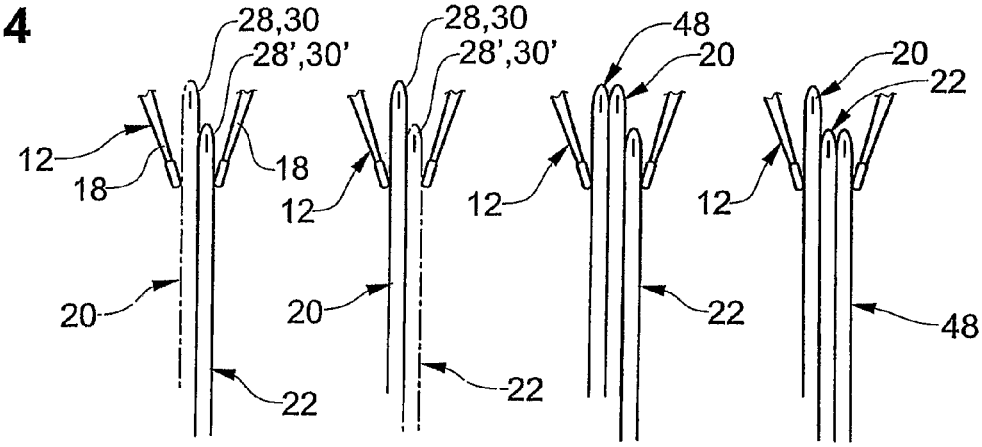
FIG. 4 shows four successive clamps from that embodiment of the transporting arrangement which is shown in FIG. 2, with different cases of the clamps being loaded incorrectly with printed products.

FIG. 4 shows the jaws 18 of four clamps 12 from that embodiment of the transporting arrangement 10 which is shown in FIG. 2, the clamps having been loaded incorrectly with printed products 20, 22. The first clamp 12, as seen from the left, has been loaded with a first printed product 20 and a second printed product 22 in the correct position. However, the first printed product 20, which is indicated by chain-dotted lines, is the incorrect printed product, which does not carry any identification information 30, or carries inappropriate identification information 30, in the region of the information zone 28. The second printed product 22 is the correct product with the appropriate identification information 30'.

The second clamp 12 has also been loaded with a first printed product 20 and a second printed product 22 in the correct position. The first printed product 20 is the correct product with the appropriate identification information 30 in the information zone 28, whereas the second printed product 22 is the incorrect product, which does not carry any identification information 30', or carries incorrect identification information 30', in the region of the information zone 28'.

The incorrect printed products 20, 22 may be, for example, incomplete printed products with at least the outermost sheet missing. It is also conceivable for the first or second printed product 20, 22, these being indicated by dashed lines in the two clamps 12 mentioned, to be missing and for the relevant clamp 12 to be loaded just with a second or first printed product 20, 22. The incorrect loading patterns of the clamps 12 which have been mentioned above can be detected by way of the optoelectronic monitoring means. If a clamp 12 has been loaded just with a single printed product 20 or 22, the latter can be used, if appropriate, for further processing, in which case it need not be ejected.

The third clamp 12 from the left in FIG. 4 has been loaded correctly with a first printed product 20 and a second printed product 22. Incorrectly, however, a third printed product 48 butts congruently against the first printed product 20, on the side of the latter which is directed away from the second printed product 22, and this third printed product is not sensed by way of the optoelectronic monitoring means alone.

The fourth clamp 12 has likewise been loaded with a first printed product 20 and a second printed product 22 in the correct position, but a third printed product 48 rests congruently on the second printed product 22, on that side of the latter which is directed away from the first printed product 20. If this third printed product 48 carries identification corresponding to the identification information 30' of the second printed product 22, the incorrect loading of the clamp 12 cannot be detected by way of the optoelectronic monitoring means alone.

It is not possible either to detect that the clamp 12 which is shown on the left-hand side in FIG. 5 has been loaded incorrectly with four printed products. Butting against the first printed product 20, on the one hand, and against the second printed product 22, on the other hand, are a respective third printed product 48 and fourth printed product 48'. In this case, the optoelectronic monitoring means establishes correct loading if the fourth printed product 48' has been provided with identification information corresponding to the identification information 30' of the second printed product 22.

In comparison with the incorrectly loaded clamps, the clamp 12 which is shown on the right-hand side in FIG. 5 has been loaded correctly with a first printed product 20 and a second printed product 22.

In order to make a check, in addition to optoelectronic monitoring, as to whether one of the clamps 12 has been loaded with more than two printed products 20, 22, an apparatus 50 for monitoring the overall thickness of the printed products 20, 22, and possibly 48, 48', transported jointly by a clamp 12 may be arranged downstream of the monitoring location 33. A suitable apparatus for monitoring the thickness of the jointly transported printed products 20, 22 is known from EP 0 897 887 A. In respect of the construction and functioning of this apparatus 50, reference is made expressly to the EP document.

FIG. 6 shows part of the transporting arrangement 10 with three clamps 12 which have been loaded correctly with a first printed product 20 and a second printed product 22. The apparatus 50 for monitoring the thickness of the printed products 20, 22 transported jointly by each clamp 12 is also located in that part of the transporting arrangement 10 which is shown.

The apparatus has a multiplicity of monitoring elements 52, which are arranged equidistantly on the circumference of a monitoring disk 54 and each essentially comprise a monitoring lever 56, which is stationary relative to the monitoring disk 54, and a monitoring lever 60, which can be pivoted about a pivot axis 58 relative to the monitoring disk 54. The two monitoring levers 56, 60 each have a clamping jaw 62 in their free end regions, the clamping jaws 62 of each monitoring element 52 being directed toward one another and being aligned with one another in order for the printed products 20, 22 transported jointly by a clamp 12 to be clamped in.

The pivotable monitoring lever 60 of each monitoring element 52 is spring-loaded in the direction of the stationary monitoring lever 56. Furthermore, it has a control roller 64 which, when the monitoring disk 54 rotates—this takes place synchronously with the movement of the clamps 12 of the transporting arrangement 10—rolls on a stationary guide means (not shown). The guide means here is configured such that the pivotable monitoring lever 60 is kept at a distance apart from the stationary monitoring lever 56, counter to the spring force, except in a monitoring region in which the monitoring element 52 interacts with the printed products 20, 22 transported jointly by a clamp 12. In this monitoring region, the control roller 14 does not roll on the corresponding guide means; rather, the position of the pivotable monitoring lever 60 is determined by the spring force and by the overall thickness of the printed products 20, 22 clamped in between the clamping jaws 62.

The thickness of the clamped-in printed products 20, 22 is determined by the position of the pivotable monitoring lever 60 in relation to the stationary monitoring lever 56, for example by optical sensing and electronic evaluation, as is known from EP 0 897 887 A.

The apparatus 50 can sense incorrect loading patterns such as those illustrated, for example, in FIG. 4 in the third and fourth clamps 12 from the left, and in FIG. 5 in the left-hand clamp 12. The apparatus 50 likewise emits control signals to the further-processing station 42, in order for account to be taken of the incorrect loading patterns during further processing.

Using the apparatuses which are shown in FIGS. 1-3, optoelectronic monitoring of the first printed products 20 and second printed products 22 transported jointly by a clamp 12 can take place as follows. As a respective clamp 12 reaches the monitoring location 33, the clamp sensor 34 emits a trigger signal T to the processing unit 40. The latter generates, and transmits to the image-recording device 38, a recording command, whereupon the image-recording device 38 records an image of the identification information 30 of the first printed product 20. With a time delay which is dependent on the conveying speed v and the desired spacing B between the leading edges 24, 24' of the first and second printed products 20, 22, the processing unit 40 emits a further recording command to the image-recording device 38, which, accordingly, records an image of the identification information 30' of the second printed product 22. The digitized images transmitted directly in each case to the processing unit 40 from the image-recording device 38 are each compared, by means of the comparison unit 46, with the data of the calibration image E.

If this comparison of the images of the identification information 30, 30' of the first printed product 20 and the second printed product 22 with the calibration image E is a positive one, a corresponding control signal S is generated and emitted to the further-processing station 42. This control signal S, however, can be dispensed with if the further-processing station 42 requires a corresponding signal S only when one of the clamps 12 has not been loaded correctly.

However, if the comparison between the recorded images and the calibration image E is a negative one for one of the recorded images, or for both recorded images, a corresponding control signal S is likewise generated and fed to the further-processing station 42. This control signal S may also be an alarm signal, in order for an alarm to be triggered when an incorrectly loaded clamp 12 is detected. The further-processing station 42 may be, for example, an ejecting station, in order for the clamps 12 which are not loaded correctly with printed products 20, 22 to be opened and for these printed products to be separated out of the conveying stream.

The abovementioned method of operating the monitoring arrangement 36 is suitable, in particular, when identical printed products 20, 22 with identical identification information 30, 30' are transported. This mode of operation can also be used to establish whether the first and/or second printed product 20, 22 is the correct or incorrect printed product.

As has already been described above, it is also possible for the image-recording device 38 to be equipped and/or arranged such that it can record an image of the entire image zone 32 with the identification information 30, 30' of the first printed product 20 and of the second printed product 22. In this case, the processing unit 40, in response to a trigger signal T, emits in each case a single recording command to the image-recording device 38. The image recorded of the image zone 32, in turn, is compared electronically, by means of the comparison unit 46, with a corresponding digitally stored calibration image E and, in dependence on the result of the comparison, the monitoring arrangement 36 generates a corresponding control signal S and transmits it to the further-processing station 42.

This mode is suitable both for the case where in each case a first printed product 20 and a second printed product 22 with the same identification information 30, 30' are to be transported by a clamp 12 and for the case where the first printed product 20 and the second printed product 22 have different pieces of identification information 30, 30'.

Of course, it is also conceivable to arrange the clamp sensor 34 upstream of the monitoring location. In this case, the processing unit 40, in response to trigger pulses T, generates the recording commands for the image-recording device 38 in a correspondingly delayed manner.

In a further operating mode, it is possible for the optoelectronic monitoring to be carried out such that the image-recording device 38 continuously records images and transmits the corresponding image data to the processing unit 40. When the latter receives a trigger signal T, it initiates—in dependence on the conveying speed v and the desired spacing B between the leading edges 24, 24' of the first and of the second printed products 20, 22—a first time window, and then a second time window, within which the comparison unit 46 compares the recorded images with the calibration image E. If a respective recorded image corresponds to the calibration image E within the first and the second time intervals, the relevant clamp 12 has been loaded correctly. Otherwise, incorrect loading has taken place. Here too, the processing unit 40, in dependence on the result of the electronic processing, generates a corresponding control signal and transmits this to the further-processing station 42.

This operating mode is suitable, in particular, when first and second printed products 20, 22 with identical identification information 30, 30' are to be transported and the speed v at which the clamps 12 move may vary. This may be the case, for example, when, rather than being fastened on a driven conveying means 14, the clamps 12 are arranged, for example, on carriages or slides which move freely along a path, for example with a gradient.

If the image-recording device 38 is equipped and/or positioned such that it can record an image of the entire image zone 32 with the identification information 30, 30' of the first printed product 20 and the second printed product 22, then, in a further operating mode, the processing unit 40, in response to a trigger signal T, initiates a time interval on the basis of which it is monitored, in the comparison unit 46, whether one of the images recorded during this time interval corresponds to the calibration image E. This operating mode is suitable, in particular, when, as is shown in the previous example, clamps 12 which follow one after the other at different speeds have to be expected. Furthermore, it is also suitable when the pieces of identification information 30, 30' of the first printed product 20 and of the second printed product 22 differ.

Depending on the type of further-processing station 42, the control signals S are used differently. If the station is, for example, a stacking arrangement, the control signals S can be used in order to form stacks with a certain number of printed products 20, 22. In this case, clamps 12 which have been loaded with incorrect printed products 20, 22 are not opened as they move past the further-processing station 42. This may likewise be the case when a clamp has been loaded just with a single printed product, whereas a further two printed products 20, 22 are required in order to complete the stack.

It is also conceivable for the clamp sensor 34 to be arranged and designed such that, rather than sensing the movement of a clamp 12 into the sensor region, it senses the movement of a printed product 20, 22 into the sensor region. In this case, the optoelectronic monitoring does not take into account the clamps 12 which have not been loaded with at least one printed product 20, 22.

The calibration operation is carried out using the same arrangement as the optoelectronic monitoring. This operation consists essentially in that, by means of the image-recording device 38, an image is made of the identification information 30, 30' of the first printed product 20 and second printed product 22 arranged correctly in a clamp 12, and this image is stored in electronically digital form in the memory 44 for the calibration image E. The calibration operation can be carried out when the transporting arrangement 10 is at a standstill, it previously being possible for the correct arrangement of the first and second printed products 20, 22 in the relevant clamp 12 and the settings on the image-recording device 38 to be visually monitored and precisely adjusted. It is also possible, however, for the calibration operation to be carried out during operation of the transporting arrangement; in this case, it is easily possible, in the operating mode in which a dedicated image is recorded for the identification information 30, 30' of each of the printed products 20, 22, to adjust the time delay between the points in time at which the first image and the second image are recorded.

It is advantageous if a larger detail is recorded for the calibration image E than is later the case for carrying out the optoelectronic monitoring. For the image comparison, it is then possible for the images recorded for optoelectronic monitoring to be shifted by software within the calibration image until maximum correspondence has been established. This makes it possible to prevent the situation where printed products 20, 22 which have been shifted slightly relative to the calibration image E, but are correct, are interpreted as being defective. The same also applies in the converse case in which, for the optoelectronic monitoring, the image detail recorded is larger than the calibration image E.

In particular for the purpose of monitoring the transportation of newspapers, periodicals or the like in which the first and second printed products 20, 22 are provided with identical printing, a detail of the printing on the printed products 20, 22 is advantageously used as identification information 30, 30'.

Monitoring of printed products 20, 22 which are transported in pairs by means of clamps 12 has been described in relation to the exemplary embodiments. However, the process according to the invention and the apparatus according to the invention are also suitable for monitoring other sheet-like products which are transported in pairs by means of clamps.

The invention claimed is:

1. A process for monitoring sheet-like products, including printed products;

wherein said products are transported by means of clamps in a transporting arrangement;

wherein a first product (20) comprising identification information (30), and a second product (22) comprising identification information (30'), are transported in a conveying direction (F), in a state in which they are retained jointly by said clamps (12);

wherein a second product (22) partially overlaps the first product (20), and wherein a peripheral portion (26) which carries the identification information (30) of the first product (20) and the identification information (30') of the second product (22) is exposed;

wherein said first and second products (20, 22) which are retained by the clamps (12) are subjected to optoelectronic monitoring as they move past a monitoring location (33), comprising a stationary image-recording device (38) that is used to record an image of the identification information (30, 30') of the first and of the second products (20, 22);

wherein the recorded image is processed electronically, and the result of the electronic processing is processed to form control signals (S) for a further processing station (42).

2. The process of claim 1, wherein a trigger signal (T) causes the image to be recorded as the printed products pass the monitoring location.

3. The process of claim 2, wherein a single joint image of the identification information (30, 30') of the first and the second products (20, 22) is recorded.

4. The process of claim 2, wherein a dedicated image of the identification information (30) is recorded of both the first product (20) and the second product (22).

5. The process as claimed in one of claims 2 to 4, wherein during the step of electronic processing, each of the recorded images is compared with a calibration image (E) which has been digitally predetermined or recorded in a calibration operation and stored.

6. The process of claim 5, wherein the trigger signal (T) is generated by a clamp sensor (34) when a clamp (12) or a product (20, 22) moves past the sensor.

7. The process of claim 1, wherein the images are recorded one after the other, wherein during the step of electronic processing, the recorded images are compared with a calibration image (E) which has been digitally predetermined or recorded in a calibration operation and stored;

and wherein a check is made as to whether one of the images recorded in a time window that is dependent on a trigger signal (T) corresponds to the calibration image (E);

wherein the calibration image (E) contains the identification information (30, 30') of the first and of the second products (20, 22).

8. The process of claim 1, wherein images are recorded one after the other, wherein during the step of electronic processing, the recorded images are compared with a calibration image (E) which has been digitally predetermined or recorded in a calibration operation and stored;

wherein a check is made as to whether one of the images recorded in a first and second time window that is dependent on a trigger signal (T) corresponds to the calibration image (E);

wherein the pieces of identification information (30, 30') of the first and of the second products (20, 22) are identical and wherein the calibration image (E) contains this identification information (30, 30').

9. The process of claim 1, wherein the first product (20) and the second product (22) are retained in a mouth (16) of the clamp (12) such that an edge (24) of the first product (20) runs at a right angle to the conveying direction (F), and is arranged further into the mouth (16) than a corresponding edge (24') of the second product (22);

wherein the edge of the second product runs substantially parallel to the edge (24) of the first product (20), and wherein the second product (22) carries the identification information (30') in a peripheral portion adjacent to its edge (24').

10. The process of claim 1, wherein a multiplicity of clamps (12) are spaced apart one behind the other on a pulling means (14) driven in circulation in a conveying direction (F), and wherein a check is made by the optoelectronic monitoring means as to whether each of the clamps (12) is loaded with a first and a second product (20, 22).

11. The process of claim 1, wherein the products (20, 22) retained by the clamps (12) are subjected to thickness measurement (50) in order to establish whether clamps (12) are loaded with more than a first and a second product (20, 22) in addition to optoelectronic monitoring.

12. The process of claim 1, wherein the products (20, 22) are printed products, and wherein a detail of the printing on the printed products is used as the identification information (30, 30').

13. An apparatus for carrying out the process of claim 1, comprising:

a transporting arrangement (10) including clamps (12) which are driven in a conveying direction (F);

wherein a first product (20), comprising identification information (30), and a second product (22), comprising identification information (30') is transported in a jointly retained manner such that the second product (22) partially overlaps the first product (20);

and wherein a peripheral portion (26), which carries the identification information (30) of the first product (20) and the identification information (30') of the second product (22) is exposed;

further comprising a stationary image-recording device (38) that is arranged at a monitoring location (33), wherein an image of the identification information (30, 30') of the first and of the second products (20, 22) is recorded;

wherein said stationary image-recording device is connected to a processing unit (40) which includes a memory (44), and subjects the recorded images to electronic processing and generates control signals (S) for a further-processing station (42) based on the result of the processing.

* * * * *